United States Patent [19]

Word

[11] 4,034,685

[45] July 12, 1977

[54] TELLER'S SHIELD

[76] Inventor: James O. Word, 207 Sixth Ave., Hattiesburg, Miss. 39401

[21] Appl. No.: 715,239

[22] Filed: Aug. 18, 1976

[51] Int. Cl.[2] ..... E06B 9/04; E05G 5/00

[52] U.S. Cl. ..... 109/17

[58] Field of Search ..... 109/2, 11–18

[56] References Cited

U.S. PATENT DOCUMENTS

| | | | |
|---|---|---|---|
| 1,573,770 | 2/1926 | Lucas | 109/18 |
| 1,593,536 | 7/1926 | McClees | 109/18 |
| 1,619,982 | 3/1927 | Lucas | 109/18 X |
| 1,919,137 | 7/1933 | Szatler | 109/17 |
| 2,984,194 | 5/1961 | Jennings | 109/17 X |

*Primary Examiner*—Paul R. Gilliam
*Assistant Examiner*—David H. Corbin

[57] ABSTRACT

A teller's shield comprising a vertically extending shield mounted relative to a teller's cage and adapted to be moved from an open position in which access to the cage is obtainable, to a closed position in which access is unobtainable. Mounting means is operatively associated with the teller's cage and the shield to permit vertical movement of the shield from the open to closed position. Foot activating means is operatively associated with the mounting means, as well as hand activating means operatively connected to the foot activating means, such that simultaneous engagement of the foot and hand activating means is required to release the shield for movement from the open position to the closed position, the foot and hand activating means being electrically powered. Manual activating means is operatively associated with the mounting means and capable of operation upon failure of the electric power to the foot and hand activating means, such that the shield may be lowered to the closed position notwithstanding a power failure.

25 Claims, 10 Drawing Figures

TELLER'S SHIELD

BACKGROUND OF THE INVENTION

The present invention relates to a protective device and primarily to a teller's shield that may be quickly activated into use.

There has been proposed in the prior art a number of devices intended to protect a teller, cashier, etc., from injury during a robbery. Certain of these devices are illustrated in U.S. Pats. No. 1,585,151; 1,645,151; 1,694,556; 1,863,680; and 2,937,602. I have found these devices deficient in their ability to properly function and at the same time not accidently activated. It is fully appreciated that accidental activation could injure either the cashier or a customer having his or her hand beneath the shield as it drops into a protective position. Also, I have found that a safety shield that is either electrically or manually operated further performs an additional safeguard into the device.

OBJECTS OF THE INVENTION

An object of the present invention is to provide a teller's shield that may be either electrically or manually operated.

Another object of the present invention is to provide a teller's shield which requires a foot and a hand of the teller for activation in order to assure that the device is not accidentally activated.

Other objects and advantages of the present invention will become apparent as the disclosure proceeds.

SUMMARY OF THE INVENTION

The invention pertains to a teller's shield or safety assembly having a vertically extending shield mounted relative to a teller's cage and adapted to be moved from an open position in which access to the case is obtainable, to a closed position in which access to the cage is obtainable, to a closed position in which access is unobtainable. Mounting means is operatively associated with the teller's cage and the shield to permit vertical movement of the shield from the open to closed position, the mounting means including a cable connected to the shield.

Foot activating means is operatively associted with the mounting means, and provided with foot housing means having the foot activating means contained therein and having an access opening to gain entrance to the foot housing means to actuate the foot activating means when required. Hand activating means is operatively connected to the foot activating means, such that simultaneous engagement of the foot and hand activating means is required to release the shield for movement from the open position to the closed position, the foot and hand activating means being electrically powered. Hand housing means having the hand activating means contained therein is provided and having an access opening to gain entrance to the hand housing means to engage the hand activating means. The shield further includes motor means operatively associated with the foot and hand activating means.

The foot housing means and the hand housing means are spaced from each other such that a respective hand and foot of the teller is required so as to avoid accidental engagement of the activating means. The foot and hand activating means each includes a switch which when simultaneously depressed will close the circuit for the motor means to become operational for lowering of the shield. Cover means on the foot housing means and the hand housing means across each of the access openings is provided such that the cover means must be opened inwardly by the teller to gain access to the respective housing means.

Manual activating means is operatively associated with the mounting means and capable of operation upon failure of the electric power to the foot and hand activating means, such that the shield may be lowered to the closed position notwithstanding a power failure. The manual activating means includes cutting means operatively associated therewith and adapted to cut the cable for lowering of the shield so as to be able to lower the shield without electric power.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
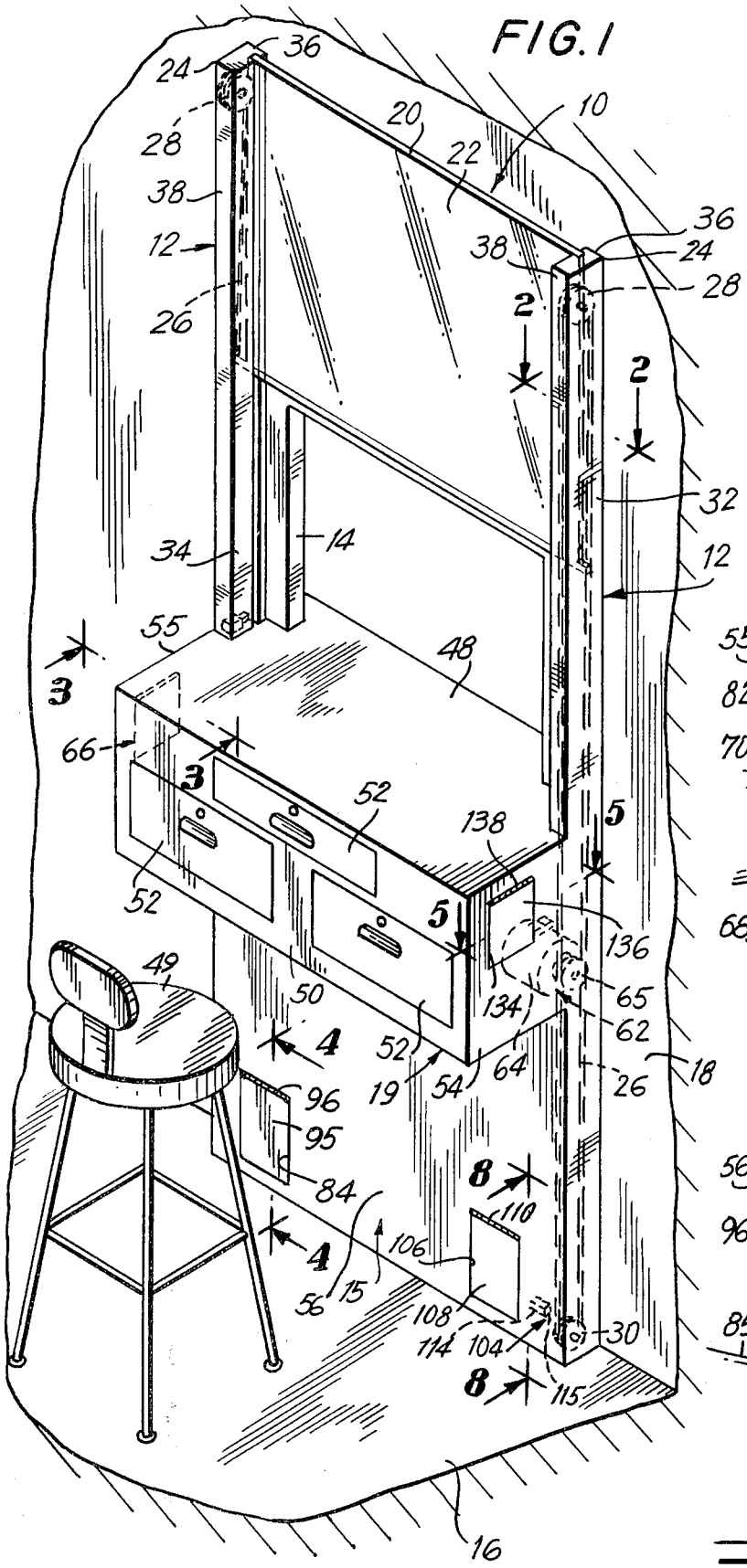
FIG. 1 is a perspective view of the teller's shield in accordance with the present invention.
Figure 9:
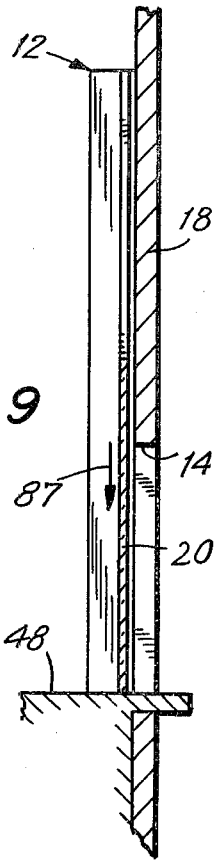
FIG. 9 is a side view, partly in section of the shield in the closed position thereof.

Referring to the drawings FIGS. 1–10 illustrate a teller's shield or assembly 10 including a vertically extending frame 12 having an open teller's cage 14 at one end thereof and an enclosed cage housing 15 at the lower end thereof. The assembly 10 is adapted to be secured to the floor 16 and enclosed by a vertical wall 18. A teller's housing 19 extends above the cage housing 15. A shield 20 having spaced apart surfaces 22 is vertically mounted relative to the teller's cage 14 and adapted to be moved from an open position, as seen in FIG. 1, in which access to the cage 14 is obtainable, to a closed position, as seen in FIG. 9, in which access is unobtainable. The cage 14 may extend through the wall 18 or defined by the frame 12.

Figure 2:
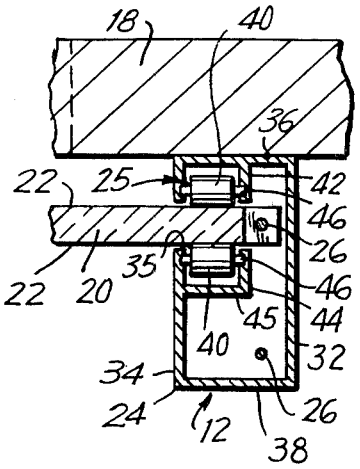
FIG. 2 is a sectional view taken along line 2—2 of FIG. 1.

The frame 12 includes a pair of vertically extending support members or channels 24 on the inside of the wall and as such is not visible to a person in the bank or other location of the assembly 10. Mounting means 25 as seen in FIG. 2, is operatively associated with the frame 12 to permit vertical movement of the shield 20 from the open to closed position. The mounting means 25 includes a cable 26 wound around an upper pulley 28 and lower pulley 30 mounted relative to the support members 24 as seen in FIG. 1. Each support member 24 includes an outer wall 32, inner wall 34 having a vertical groove 35 therein extending therein. Front wall 36 and rear wall 38 define the other vertical walls of the support member 24.

A pair of rollers 40 is mounted on each respective side 22 of the shield 20 and permits the downward movement when required. The shield 20 may be made from bullet proof glass, etc. A pair of flange members 42 and 44 extend in spaced relationship to the spaced apart inner wall 34. Flange member 42 is connected to the front wall 36 and flange member 44 is connected by rib 45 to the inner wall 34. A shaft 46 supports each roller 40.

The teller's housing 19 includes a top or platform 48 that may extend past the wall 18 with the open teller's cage 14 thereon, and easily reached when sitting on the stool 49. The front end 50 of the teller's housing 19 may contain the cash drawers 52. A pair of side or end walls 54 and 55 are provided on each side of the teller's housing 19 and may coincide with the outer walls 32.

The cage housing 15 includes a front wall 56 that extends inwardly of the front end 50 and may be in line with the rear wall 38 of each support member 24.

Figure 3:
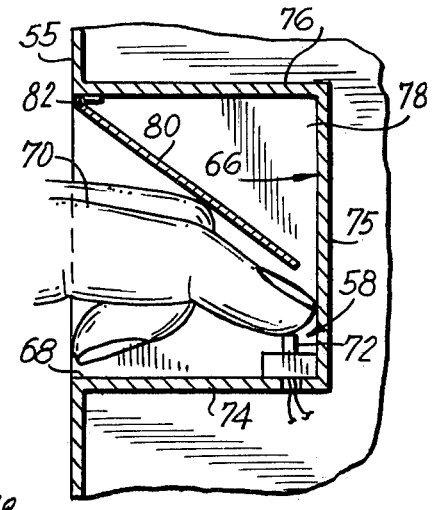
FIG. 3 is a sectional view taken along line 3—3 of FIG. 1.
Figure 4:
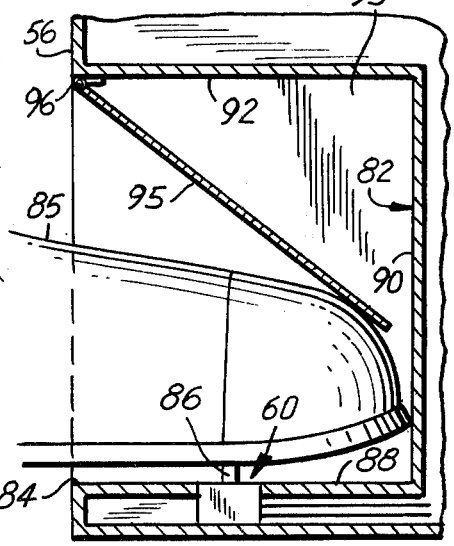
FIG. 4 is a sectional view taken along line 4—4 of FIG. 1.

To safeguard the teller, cashier, etc. hand activating means 58 and foot activating means 60, as illustrated in FIGS. 3 and 4 is provided. The hand activating means 58 and foot activating means 60 are both operatively associated with each other and the mounting means 25. The assembly 10 is so designed such that simultaneous engagement of the foot activating means 58 and hand activating means 60 is required to release the shield 20 for movement from the open position to the closed position. The foot and hand activating means being electrically powered by motor means 62 including an electric motor 64 having a pulley 65 for engaging and driving the cable 26.

Accordingly the foot housing means 60 and the hand housing means 58 may be spaced from each other such that a hand and foot of the teller is required so as to avoid accidental engagement of the respective activating means. Hand housing means 66 is provided on end wall 55 with the hand activating means 58 contained therein and having an access opening 68 to gain entrance by the teller's hand 70 the hand housing means 66 to engage the hand activating means 58 which includes a switch 72. The hand housing means 66 includes a bottom or base 74, back stop 75, and top 76, as well as side walls 78. Hand housing cover means 80 is hingeably mounted by hinge 82 across the access opening 68 such that the hand housing cover means 80 must be opened inwardly by the teller to gain access to the switch 72.

Figure 10:
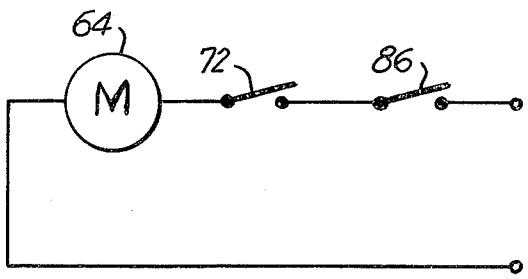
FIG. 10 is an electrical schematic of the present invention.

Foot housing means 82, as seen in FIG. 4, is provided on front wall 56 with the foot activating means 60 contained therein and having an access opening 84 to gain entrance for the shoe 85 into the foot housing means 82 to actuate the foot activating means 60 that includes a switch 86. The switch 72 and switch 86 are both wired together as seen in FIG. 10, such that when both are simultaneously depressed the circuit for the motor 64 will be closed and operational for lowering the shield 20 in the direction of arrow 87 as seen in FIG. 9. The motor 64 causes the pulley 65 to frictionally engage the cable 26 and in a very short period of time the shield 20 is lowered into the protective position for the teller.

The foot housing means 82 includes a base 88 above which the switch 86 extends. A back end 90, and top end 92 are provided as well as side ends 93. Foot housing cover means 95 is hingeably mounted by hinge 96 across the access opening 84 such that the foot housing cover means 95 must be opened inwardly by the teller's shoe 85 to gain access to the switch 86. In this manner the activating means is hidden from view and accidental activation thereof is eliminated. There are no exposed switches that may be accidently engaged by the teller or someone standing nearby. A positive coordinated motion of one hand and one foot of the teller is required to activate the assembly or unit 10.

The present invention also takes into consideration that the possibility exists that a power failure could take place. Furthermore if a malfunction of the electric motor 64 or switch 72 or 86 takes place, the assembly 10 is still functional by the provision of foot manual activating means 100 and hand manual activating means 102.

The foot manual activating means 100 as illustrated in FIG. 4, includes foot cutting means 104 operatively associated therewith and adapted to cut the cable 28 for lowering of the shield 20 so as to be able to lower the shield 20 without electric power. The foot manual activating means 100 includes manual foot housing means 105 with the cutting means 104 mounted therein and having an access opening 106 on front wall 56 to gain entrance to the manual foot housing means 105 to engage the manual foot activating means 104.

Figure 8:
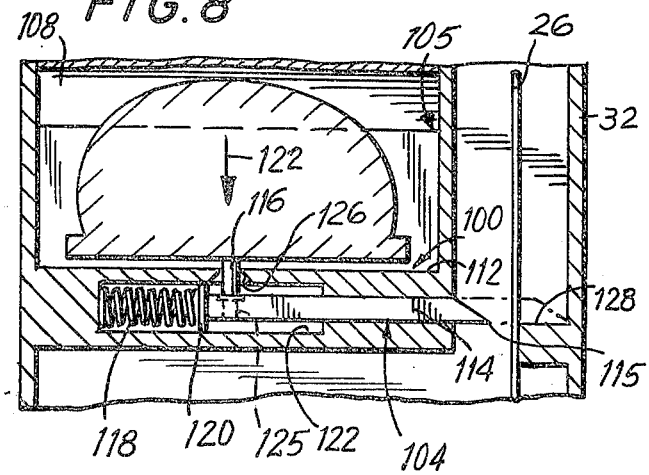
FIG. 8 is a sectional view taken along line 8—8 of FIG. 1.

The foot manual housing means 105 includes cover means 108 mounted by hinge 110 at the upper end thereof such that the cover means 108 opens inwardly by the foot of the teller. A floor 112 has a spring loaded cutting member 114 contained therein with a cutting edge 115 adapted to be moved from a retracted position as seen in FIG. 8, to an extended position as illustrated in phantom. A pin 116 is the means for releasing the cutting member 114 so that its edge 115 engages and severs the cable 26 so as to automatically lower the shield 20. The spring 118 extends axially against the head 120 in the axial bore 122. The pin 116 when forced downwardly in the direction of arrow 124 falls within an opening 125 extending within the cutting member 114 and through the counter-bored opening 126 in the floor 112. This releases the cutting member 114. A ledge 128 extends outwardly from the wall 32 and in alignment therewith.

Figure 5:
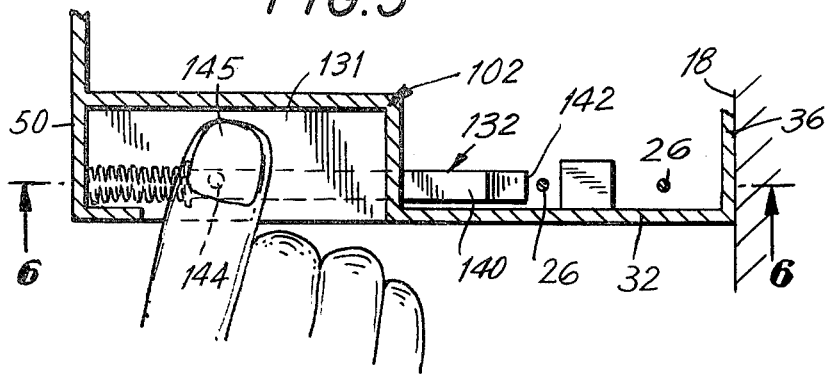
FIG. 5 is a sectional view taken along line 5—5 of FIG. 1.
Figure 6:
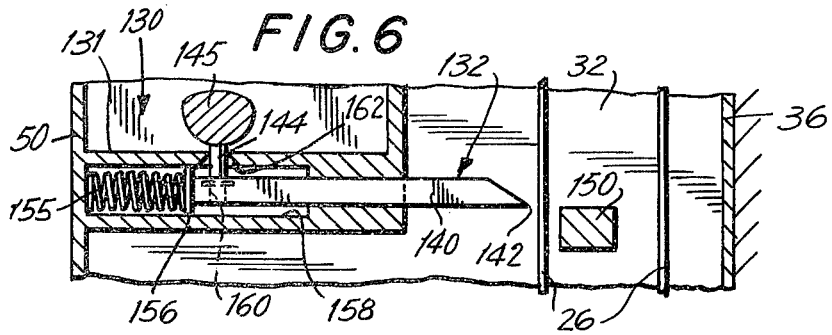
FIG. 6 is a top view of the device illustrated in FIG. 6 in the retracted position.
Figure 7:
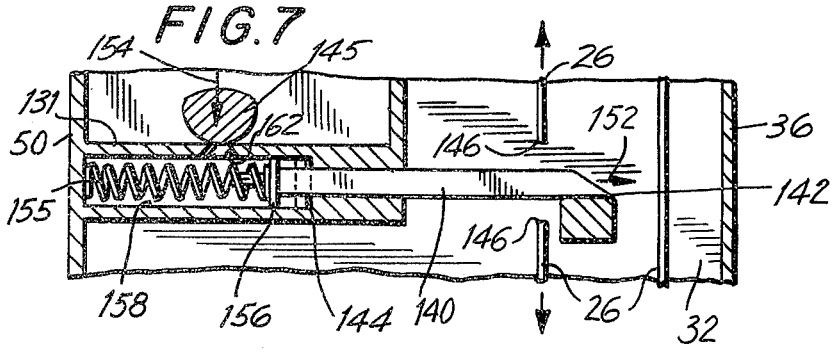
FIG. 7 is a view of the device in FIG. 6 in the extended position.

In vertically spaced relationship to the manual foot activating means 100 is manual hand activating means 102, illustrated in FIGS. 5–7. The manual hand activating means 102 includes housing means 130 having cutting means 132 contained therein and having an access opening 134 to gain entrance to the top 131 of the manual hand housing means 130 to engage the manual hand activating means 102. Manual cover means 136 is provided with the manual hand housing means 130 and mounted by a hinge 138 such that the manual cover means 136 must be opened inwardly by the teller to gain access to the manual hand housing means 130. The cutting means 132 includes a spring loaded cutting member 140 having a cutting edge 142 to be moved from a retracted position of FIG. 6, to an extended position of FIG. 7. A pin 144, is adapted to be engaged by the finger 145 of the teller, and acts as the means for releasing the cutting member 140 such that the cutting edge 142 engages the cable 26 and severs same 140 as 146 so as to automatically lower the shield 20.

A ledge 150 is mounted from the side wall 32 and adapted to receive the cutting edge 142 in the direction of arrow 152 when the pin 144 is depressed in the direction of arrow 154. The spring 155 abuts the housing wall 50 and the head 156 extends in an axial bore 158 with the pin adapted to extend into opening 160 in cutting member 140. The pin 144 can extend through the counter-bored opening 162 in the top 131 and when depressed will release the cutting member 140 to sever the cable 26.

Accordingly the cutting means 104 and 132 extend in a plane substantially normal to the cable 26 and either cutting means is capable to cut the cable to lower the shield 20.

Although an illustrative embodiment of the invention has been described in detail herein with reference to the accompanying drawings, it is to be understood that the invention is not limited to the precise embodiment, and that various changes and modifications may be effected therein without departing from the scope or spirit of the invention.

I claim:

1. A teller's shield comprising:

a. a vertically extending shield mounted relative to a teller's cage and adapted to be moved from an open position in which access to the cage is obtainable, to a closed position in which access is unobtainable, b. mounting means operatively associated with said teller's cage and said shield to permit vertical movement of said shield from said open to closed position, said mounting means including a cable connected to said shield, c. foot activating means operatively associated with said mounting means, d. hand activating means operatively connected to said foot activating means, such that simultaneous engagement of said foot and hand activating means is required to release said shield for movement from the open position to the closed position, said foot and hand activating means being electrically powered, and e. manual activating means operatively associated with said mounting means and capable of operation upon failure of the electric power to said foot and hand activating means, such that said shield may be lowered to the closed position notwithstanding a power failure.

2. A teller's shield as in claim 1, and further including:

a. foot housing means having said foot activating means contained therein and having an access opening to gain entrance to said foot housing means to actuate said foot activating means, and b. hand housing means having said hand activating means contained therein and having an access opening to gain entrance to said hand housing means to engage said hand activating means.

3. A teller's shield as in claim 2, wherein said foot housing means and said hand means are spaced from each other such that a respective hand and foot of the teller is required so as to avoid accidental engagement of said activating means.

4. A teller's shield as in claim 2, and further including cover means on said foot housing means and said housing means across each said access opening, such that said cover means must be opened inwardly by the teller to gain access to said respective housing means.

5. A teller's shield as in claim 1, and further including motor means operatively associated with said cable and said foot and hand activating means for lowering of said shield.

6. A teller's shield as in claim 5, wherein said foot and hand activating means each includes a switch which when simultaneously depressed will close the circuit for said motor means to become operational for lowering of said shield.

7. A teller's shield as in claim 1, and further including a vertically extending frame having an open cage at one end thereof, and an enclosed cage housing at the lower end thereof containing said foot and hand housing means.

8. A teller's shield as in claim 1, wherein said manual activating means includes cutting means operatively associated therewith and adapted to cut said cable for lowering of said shield so as to be able to lower said shield without electric power.

9. A teller's shield as in claim 8, wherein said manual activating means is foot actuated.

10. A teller's shield as in claim 9, wherein said manual activating means includes manual foot housing means with said cutting means mounted therein and having an access opening to gain entrance to said manual foot housing means to engage said manual foot activating means.

11. A teller's shield as in claim 8, wherein said manual activating means is hand actuated.

12. A teller's shield as in claim 11, wherein said manual activating means includes manual hand housing means with said cutting means mounted therein and having an access opening to gain entrance to said manual hand housing means to engage said manual hand activating means.

13. A teller's shield as in claim 8, wherein said manual activating means may be hand or foot actuated, and includes a spaced apart pair of said cutting means.

14. A teller's shield as in claim 13, and further including:

a. manual foot housing means having one of said cutting means contained therein and having an access opening to gain entrance to said manual foot housing means to engage said manual activating means, and b. manual hand housing means having one to said cutting means contained therein and having an access opening to gain entrance to said manual hand housing means to engage said manual activating means.

15. A teller's shield as in claim 14, and further including manual cover means on said manual foot housing means and said manual hand housing means across each said access opening, such that said manual cover means must be opened inwardly by the teller to gain access to said respective manual housing means.

16. A teller's shield as in claim 14, wherein each said cutting means includes:

a. a spring loaded cutting member having a cutting edge and adapted to be moved from a retracted to an extended position, and b. means for releasing said cutting member such that said cutting edge engages said cable and severs same so as to automatically lower said shield.

17. A teller'shield comprising:

a. a vertically extending shield mounted relative to a teller's cage and adapted to be moved from an open position in which access to the cage is obtainable, to a closed position in which access is unobtainable, b. mounting means operatively associated with said teller's cage and said shield to permit vertical movement of said shield from said open to closed position, said mounting means including a cable connected to said shield, c. foot activating means operatively associated with said mounting means, d. foot housing means having said foot activating means contained therein and having an access opening to gain entrance to said foot housing means to actuate said foot activating means.

e. hand activating means operatively connected to said foot activating means, such that simultaneous engagement of said foot and hand activating means is required to release said shield for movement from the open position to the closed position, said foot and hand activating means being electrically powered, f. hand housing means having said hand activating means contained therein and having an access opening to gain entrance to said hand housing means to engage said hand activating means, g. motor means operatively associated with said foot and hand activating means, h. said foot housing means and said hand housing means are spaced from each other such that the opposite hand and foot of the teller is required so as to avoid accidental engagement of said activating means, i. said foot and hand activating means each includes a switch which when simultaneously depressed will close the circuit for said motor means to become operational for lowering of said shield, j. and further including cover means on said foot housing means and said hand housing means across each said access opening, such that said cover means must be opened inwardly by the teller to gain access to said respective housing means, and k. manual activating means operatively associated with said mounting means and capable of operation upon failure of the electric power to said foot and hand activating means, such that said shield may be lowered to the closed position notwithstanding a power failure, said manual activating means includes cutting means operatively associated therewith and adapted to cut said cable for lowering of said shield so as to be able to lower said shield without electric power.

18. A teller's shield as in claim 17, wherein said foot and hand housing means extend in a plane substantially normal to each other.

19. A teller's shield as in claim 17, wherein said manual activating means may be hand or foot actuated, and includes a spaced part pair of said cutting means.

20. A teller's shield as in claim 19, and further including:

a. manual foot housing means having one of said cutting means contained therein and having an access opening to gain entrance to said manual foot housing means to engage said manual activating means, and b. manual hand housing means having one of said cutting means contained therein and having an access opening to gain entrance to said manual hand housing means to engage said manual activating means.

21. A teller's shield as in claim 20, and further including manual cover means on said manual foot housing means and said manual hand housing means across each said access opening, such that said manual cover means must be opened inwardly by the teller to gain access to said respective manual housing means.

22. A teller's shield as in claim 21, wherein each said cutting means includes:

a. spring loaded cutting member having a cutting edge and to be moved from a retracted to an extended position, and b. means for releasing said cutting member such that said cutting edge engages said cable and severs same so as to automatically lower said shield.

23. A teller's shield as in claim 17, wherein said mounting means includes:

a. a vertically extending pair of spaced apart channels for receiving said shield therebetween, b. a pair of rollers on each side of said shield extending within said channels for rolling contact with said shield, and c. said cable extending vertically in one of said channels for engagement by said cutting means.

24. A teller's shield as in claim 23, wherein said cutting means extends in a plane substantially normal to said cable.

25. A teller's shield as in claim 17, wherein said manual activating means includes a pin which when depressed releases said cutting means.

* * * * *